United States Patent [19]

Wollman

[11] Patent Number: 4,757,486

[45] Date of Patent: Jul. 12, 1988

[54] WATCH CASE AND BRACELET ASSEMBLY HAVING A SOLDERED LOOK

[75] Inventor: Jack Wollman, Manhasset, N.Y.

[73] Assignee: Bulova Watch Co., Inc., Woodside, N.Y.

[21] Appl. No.: 48,141

[22] Filed: May 11, 1987

Related U.S. Application Data

[63] Continuation-in-part of Ser. No. 915,612, Oct. 6, 1986, Pat. No. 4,664,533.

[51] Int. Cl.[4] ..... G04B 37/12; A44C 5/00

[52] U.S. Cl. ..... 368/282; 224/164

[58] Field of Search ..... 368/281–282; 224/164–180

[56] References Cited

U.S. PATENT DOCUMENTS

| | | | |
|---|---|---|---|
| 3,469,391 | 9/1969 | Thevenaz | 368/282 |
| 4,194,355 | 3/1980 | Nishioa | 368/282 |
| 4,417,821 | 11/1983 | Herchenbach | 368/281 |

FOREIGN PATENT DOCUMENTS

| | | | |
|---|---|---|---|
| 481416 | 7/1969 | Switzerland | 368/282 |
| 645498 | 10/1984 | Switzerland | 368/282 |
| 654713 | 3/1986 | Switzerland | 368/282 |

*Primary Examiner*—Vit W. Miska

[57] ABSTRACT

A metal watch case and metal bracelet assembly in which the tail ends of the bracelet components are attachable to the complementary ends of the case in a manner simulating a "soldered look," yet these components may readily be detached to replace the bracelet. The case has a frame-like form defined by a pair of opposing side legs and a pair of opposing end legs, each end leg having a slot indented therein at its rear. The rear of the case is depressed along its inner periphery to form a socket for accommodating the watch movement so that its dial is exposed at the front of the case. Attached to the tail of each bracelet component is a connector having a hook projecting therefrom that is received in the slot of the related end leg. Snap fitting into the socket behind the movement is a cover plate having a marginal flange that overlies the slots of the end legs of the case to entrap the hooks of the bracelet components, whereby to detach these components from the case one has only to unsnap the cover plate.

5 Claims, 2 Drawing Sheets

WATCH CASE AND BRACELET ASSEMBLY HAVING A SOLDERED LOOK

RELATED APPLICATION

This application is a continuation-in-part of my pending application Ser. No. 915,612, filed Oct. 6, 1986, now U.S. Pat. No. 4,664,533, entitled "Improved Watch Case And Bracelet Assembly," whose entire disclosure is incorporated herein by reference.

BACKGROUND OF INVENTION

1. Field of Invention

This invention relates to timekeeping wrist watches, and in particular to a metal watch case and metal bracelet assembly in which the components of the bracelet are linked to the complementary ends of the case in a manner simulating a "soldered look."

2. Status of Prior Art

In conventional modern watches, the timekeeping movement is housed within a metal case provided with a pair of projecting lugs at either end. Each pair of lugs is bridged by a retractable cross bar having spring-biased pins or pintles extending axially therefrom to be received within small cavities formed in the lugs. The watch strap or bracelet associated with the case may be fabricated of leather, plastic, metal or other flexible material, the strap being constituted by two complementary components whose adjacent ends terminate in a buckle, a clasp or other means to join the components together at a position appropriate to the size of the wearer's wrist. The other ends of tails of the strap components are in a looped formation or are provided with a fixture having a transverse bore to admit the cross bar, thereby linking the components to the case.

The conventional case and bracelet arrangement makes it a relatively simple matter to couple or decouple the strap or bracelet components. In order, therefore, to replace a worn bracelet with a fresh bracelet of the same or different design, one need only displace the pintles inwardly with a suitable tool to release the cross bar from the lugs, after which the bars are removed from the worn bracelet component and inserted in the loops or bores of the fresh components which are then linked to the projecting lugs of the case.

From the standpoint of aesthetics or ornamental design, a conventional linked case and bracelet assembly in which the case is provided with opposing pairs of projecting lugs is incompatible with modern design trends. Current design directions reflect the "minimalist" school of art and is toward extreme simplicity and the avoidance of detail. In order, therefore, to create a watch case and bracelet having a severe and uncluttered appearance, it is now the practice with metal bracelets to weld or solder the bracelet components to the ends of a case having no projecting lugs. This simple integration of bracelet and case has an appearance that is often referred to in the trade as the "soldered look."

The "soldered look," though it satisfies modern design trends, has distinct practical drawbacks. If the bracelet is worn or damaged and in need of replacement, or the wearer wishes to replace an existing metal bracelet with a bracelet having a different ornamental appearance, he cannot do so; for the bracelet is permanently integrated with the case. Hence, to replace a damaged bracelet one must first take the watch movement out of the case and insert it into a new integrated case and bracelet combination, even though the case may still be in good condition.

In my prior U.S. Pat. No. 4,432,655, there is disclosed an integrated watch case and metal bracelet assembly in which the components of the bracelet are so linked to the complementary ends of the case as to simulate "a soldered look."

In my patented metal watch case and metal bracelet assembly, the tail ends of the bracelet components are attachable to the complementary ends of the case in a manner simulating a "soldered look," yet these components may readily be detached to replace the bracelet. The case which is adapted to accommodate the watch movement has straight ends each provided with a longitudinal groove, the case having at its midpoint adjacent each end a threaded bore to receive a holding screw which when turned in penetrates the related groove. Each bracelet component terminates in a split tail pin which is slidable into the groove at the complementary end of the case and is locked therein by the holding screw which when turned in extends into the mid space between the half pieces of the pin; hence to detach the component from the case, one has merely to turn out the screw.

An integrated assembly of the type disclosed in my prior patent is somewhat more expensive to manufacture than a watch in which the bracelet is welded or soldered to the case, for the use of a screw requires that a tapped hole be provided therefor. Moreover, while the use of a screw to lock the bracelet to the watch case makes it easy when necessary to replace the bracelet without the need for special tools for this purpose and thereby obviates the need to transfer the movement to a new case as with a soldered bracelet, it also has the usual disadvantages of a screw. Screws tend in time to loosen, and this can happen without the wearer of the watch being aware of this condition. This may result in the detachment of the bracelet from the watch case, and possibly the loss of the watch.

My above-identified copending application discloses an improved watch case and metal bracelet assembly in which the components of the bracelet are linked to the complementary ends of the case in a manner simulating a "soldered look," this linkage being effected not by a screw but by a bendable tab.

The advantage of an integrated case and bracelet assembly of the type disclosed in my copending application is that the wearer himself may attach or detach the components of the bracelet by bending the tab without the need for special tools for this purpose. A further advantage resides in the fact that an existing bracelet may be replaced with fresh components of the same or different design while retaining the same watch case, thereby obviating the need to transfer the movement to a new case.

In my copending application, the case which is adapted to accommodate the watch movement has straight ends each provided with a longitudinal keyway defined by parallel ridges, one of which has a midpoint gap therein occupied by a projecting tab. Each bracelet component terminates in a split tail pin which is slidable into the keyway at the complementary end of the case and is locked therein by the tab which when bent down extends into the mid space between the half pieces of the pin.

There are two objections to the "soldered look" watch arrangement disclosed in my copending application, one aesthetic in nature and the other practical. The small tab by which each bracelet component is locked to the case and that gap which receives the tab are visible. This somewhat disturbs the soldered look which ideally should reveal no evidence of a mechanical connection. Second, in order to replace a bracelet, one must unbend the locking tabs, and this is difficult for the typical user to do with ordinary tools. Moreover, if one replaces the bracelet on several occasions, this may result in metal fatigue and cause the tab to break off, as a result of which a new case must be provided.

Of prior art background interest are the U.S. Pat. Nos. to Starke, 2,446,065; Haber, 3,975,889; Kiegami et al., 4,564,308, and Bert, Re. 28,793, as well as the Swiss patent Nos. 280,560 (5/52); 337,465 (5/59); 380,035 (3/64); 473,421 (7/69) and 570,647 (7/75).

SUMMARY OF INVENTION

The main object of this invention is to provide a watch case and bracelet assembly in which the components of the bracelet are so linked by connectors to the complementary ends of the case as to simulate a soldered look which is in no way disturbed by any evidence of a mechanical connection.

More particularly, an object of this invention is to provide a watch case and bracelet assembly in which the snap-in cover plate which serves to lock the watch movement in the case also functions to lock the bracelet component connectors to the case, whereby these components may readily be joined to the case or detached therefrom.

A significant advantage of an assembly in accordance with the invention in which the bracelet components can be readily joined to the case or detached therefrom is that existing bracelet components may be replaced with fresh components of the same or different design while retaining the same case, thereby obviating the need to transfer the movement to a new case.

Briefly stated, these objects are attained in a metal watch case and metal bracelet assembly in which the tail ends of the bracelet components are attachable to the complementary ends of the case in a manner simulating a "soldered look," yet these components may readily be detached to replace the bracelet. The case has a frame-like form defined by a pair of opposing side legs and a pair of opposing end legs, each end leg having a slot indented therein at its rear. The rear of the case is depressed along its inner periphery to form a socket for accommodating the watch movement so that its dial is exposed at the front of the case. Attached to the tail of each bracelet component is a connector having a hook projecting therefrom that is received in the slot of the related end leg. Snap fitting into the socket behind the movement is a cover plate having a marginal flange that overlies the slots of the end legs of the case to entrap the hooks of the bracelet components, whereby to detach these components from the case one has only to unsnap the cover plate.

BRIEF DESCRIPTION OF DRAWINGS

For a better understanding of the invention as well as other objects and further features thereof, reference is made to the following detailed description to be read in conjunction with the accompanying drawings, wherein:

FIG. 8 shows the cover plate snapped onto the case to enclose the watch movement and entrap the connector hooks.

DESCRIPTION OF INVENTION

Figure 1:
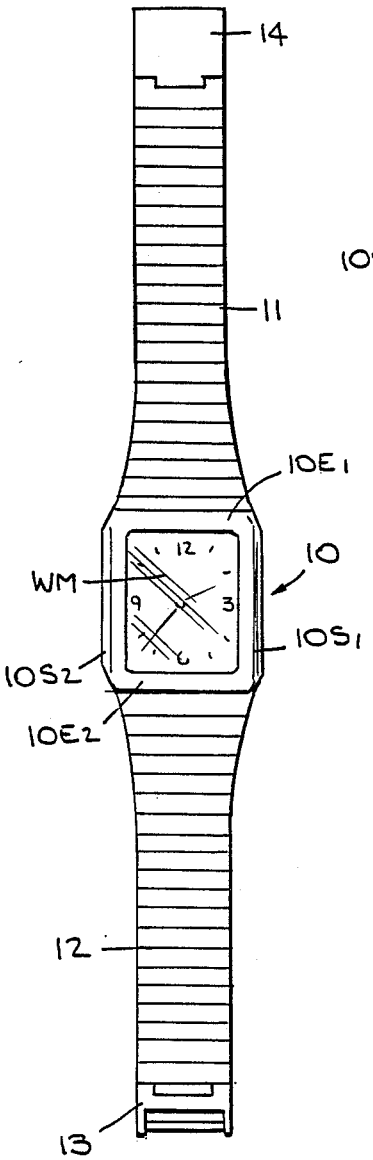
FIG. 1 is a plan view, as seen from the front face of an integrated watch case and bracelet assembly in accordance with the invention.
Figure 2:
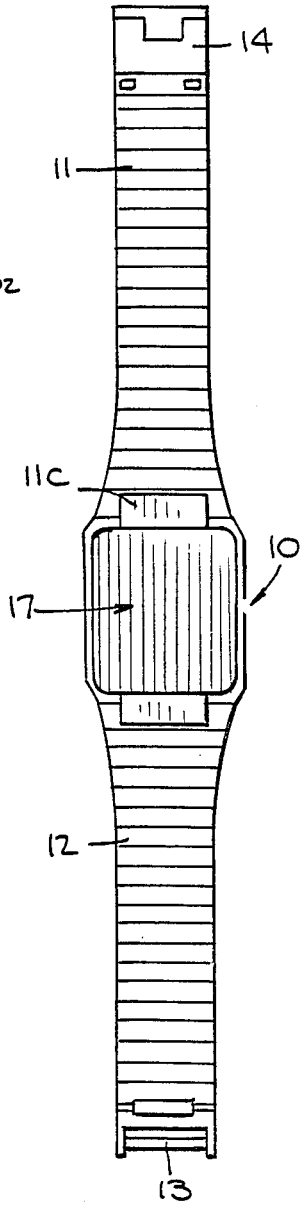
FIG. 2 is a plan view, as seen from the rear face of the assembly.
Figure 4:
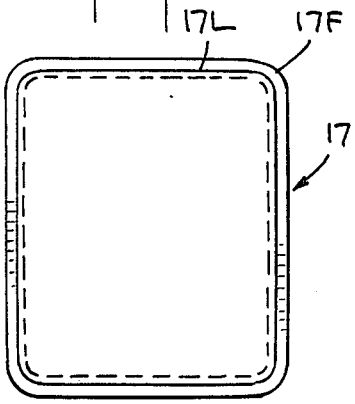
FIG. 4 is a rear view of the cover plate.

Referring now to FIGS. 1 and 2, there is shown in front and rear view a watch case and metal bracelet assembly according to the invention which when the assembly is worn on a wearer's wrist appears to have a clean and uncluttered soldered look. The assembly includes a frame-like rectangular case 10 having a pair of opposing side legs 10S$_1$ and 10S$_2$ and a pair of opposing end legs 10E$_1$ and 10E$_2$. Also provided is a metal bracelet whose components 11 and 12 are linked to the end legs 10E$_1$ and 10E$_2$ of the case. The fact that these components are detachable and not actually soldered to the case is not apparent on either the front or rear face of the case.

Contained within case 10 is a watch movement WM whose dial and hands are exposed at the front face of the case, the movement being enclosed in the case by a snap-in cover plate 17.

The leading ends of bracelet components 11 and 12 are provided with complementary clasp elements 13 and 14, respectively, which serve to join these components when the bracelet encircles the wrist of the wearer. These clasp elements form no part of the invention, for other known forms thereof may be used for the same purpose.

Figure 3:
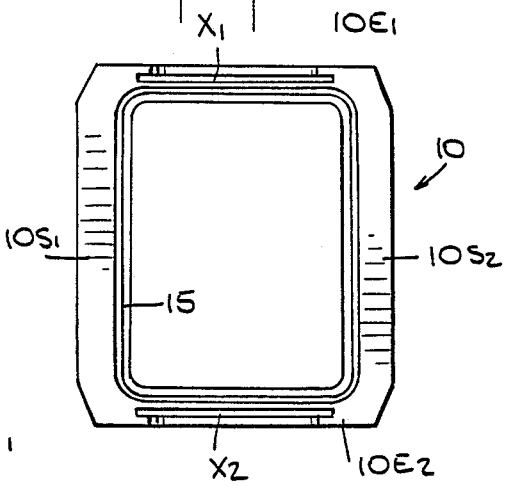
FIG. 3 is a rear view of the case.
Figure 5:
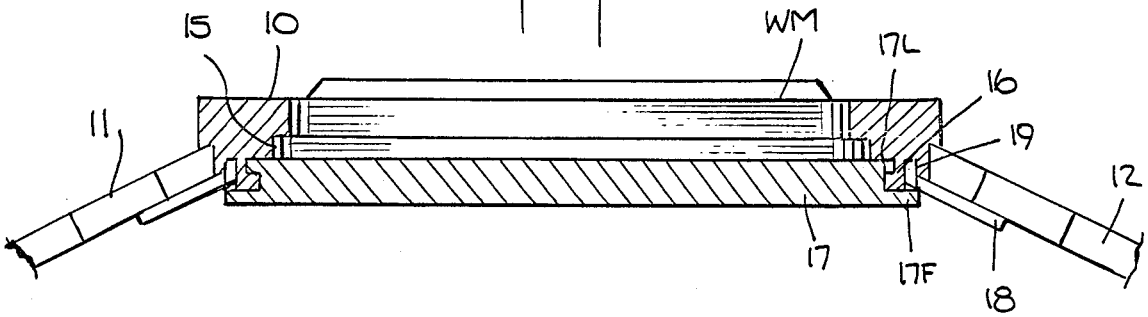
FIG. 5 is an exploded view of the watch case and metal bracelet assembly.
Figures 5, 6, 7:
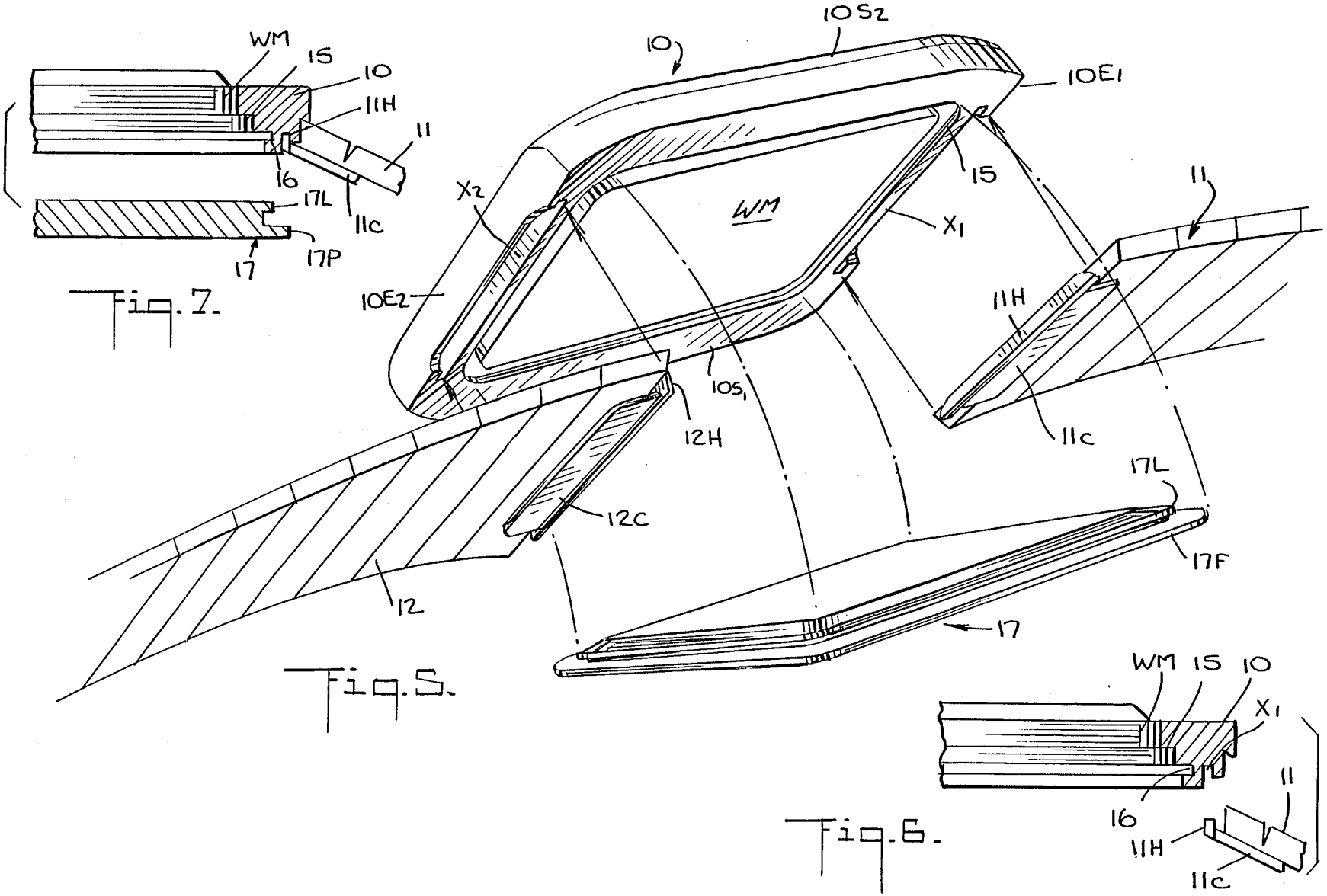
FIG. 6 shows the relationship of the connector hook of a bracelet component to the slot in an end leg of the case.
FIG. 7 shows the connector hook in the end leg slot and its relationship to the cover plate.

As best seen in FIGS. 3 and 5, the rear of case 10 is depressed along its inner periphery to form a rectangular socket 15 to receive watch movement WM. Formed in the peripheral wall of socket 15 is a continuous groove 16 adapted to receive a lip 17L at the undersurface of cover plate 17 so that the cover plate snaps into the socket behind the watch movement.

Cover plate 17, which is generally rectangular in form, has at its upper surface a marginal flange 17F which overlies the legs of the case.

Formed in end legs 10E$_1$ and 10E$_2$ at the rear thereof and parallel therewith are straight slots $X_1$ and $X_2$. The tail ends of bracelet components 11 and 12 have welded thereon metal connectors 11C and 12C, each having a hook (11H and 12H) projecting therefrom. Hooks 11H and 12H are dimensioned to fit neatly within slots $X_1$ and $X_2$, respectively; hence these slots function as receptacles for the metal connector hooks.

When cover plate 17 is snapped onto the case, its flange 17F overlies slots $X_1$ and $X_2$ in the end legs to entrap the component connector hooks 11H and 12H, thereby securely joining the bracelet components to the case.

It is important to note that any force applied to a a bracelet component which seeks to angle this component relative to the case will cause the connector hook (11H or 12H) to press against a side wall of the slot ($X_1$ or $X_2$) and therefore impose no force on cover plate 17 which might unsnap it. But if one wishes to detach the bracelet from the case in order to replace it with another bracelet, this can be done simply by prying off the cover plate with a blade or other simple tool so that the bracelet components can be detached. Hence it is an easy matter for the user of the watch to replace the bracelet when an occasion arises to do so.

While there has been shown and described a preferred embodiment of a watch case and bracelet assembly having a soldered look in accordance with the invention, it will be appreciated that many changes and modifications may be made therein without, however, departing from the essential spirit thereof.

I claim:

1. A metal watch case and bracelet assembly in which the metal bracelet components are so attached by their tail ends to the case as to simulate a soldered look, yet these components may readily be detached to replace the bracelet, said assembly comprising:

A. a metal case provided with a pair of opposing end legs, each end leg at its rear having a slot indented therein which is defined by parallel walls, the rear of the case being depressed along its inner periphery to define a socket for nesting a watch movement;

B. a connector formed of sheet metal attached to the tail end of each bracelet component and having an inclined hook projecting therefrom which is snugly received in the related slot of the case; and C. a cover plate received in said socket to enclose the movement therein, said plate having a flange which overlies the slots in the end legss of the case to entrap the hooks therein, whereby any force which seeks to angle the bracelet components with respect to the case causes the hooks in the slots to press against one of the walls so that the force is not applied to the flange of the cover plate, and to detach the bracelet components from the case, one has only to remove the cover plate.

2. An assembly as set forth in claim 1, wherein said cover plate is provided at its underface with a lip that is received in a groove formed in the peripheral wall of the socket, whereby the cover plate snaps into the socket.

3. An assembly as set forth in claim 1, wherein said case has a rectangular frame formation to define said end legs and a pair of opposing side legs.

4. An assembly as set forth in claim 2, wherein said connector is welded to the tail of said bracelet component.

5. An assembly as set forth in claim 1, wherein the leading ends of the bracelet components are provided with clasp elements.

* * * * *